US006369775B1

(12) United States Patent
Moore et al.

(10) Patent No.: US 6,369,775 B1
(45) Date of Patent: Apr. 9, 2002

(54) ANTENNA ASSEMBLY AND MULTIBAND STUBBY ANTENNA

(75) Inventors: Thomas G. Moore, Mount Prospect; Eugene Borisov, Wheeling; Alan Derdzinski, Cary; Dan Repplinger, Hawthorn Woods, all of IL (US)

(73) Assignee: Amphenol-T&M Antennas, Vernon Hills, IL (US)

( * ) Notice: Subject to any disclaimer, the term of this patent is extended or adjusted under 35 U.S.C. 154(b) by 0 days.

(21) Appl. No.: 09/669,504

(22) Filed: Sep. 25, 2000

(51) Int. Cl.[7] ..... H01Q 21/00

(52) U.S. Cl. ..... 343/893; 343/702; 343/895; 343/906

(58) Field of Search ..... 343/702, 722, 343/725, 749, 751, 895, 900, 904, 906, 893

(56) References Cited

U.S. PATENT DOCUMENTS

| | | | | |
|---|---|---|---|---|
| 5,892,480 A | | 4/1999 | Killen | 343/385 |
| 5,986,619 A | | 11/1999 | Grybos et al. | 343/895 |
| 6,046,699 A | | 4/2000 | Elliott et al. | 343/702 |
| 6,140,973 A | * | 10/2000 | Annamaa et al. | 343/790 |
| 6,163,300 A | * | 12/2000 | Ishikawa et al. | 343/702 |
| 6,198,440 B1 | * | 3/2001 | Ha et al. | 343/702 |
| 6,198,448 B1 | * | 3/2001 | Suzuki et al. | 343/725 |

* cited by examiner

*Primary Examiner*—Don Wong
*Assistant Examiner*—Shih-Chao Chen

(74) *Attorney, Agent, or Firm*—Greer, Burns & Crain, Ltd.

(57) ABSTRACT

A preferred compact antenna assembly of the invention includes a nonconductive hollow core plug. The core plug has a recessed pattern on an outside surface into which a helical radiator is wound. An end portion of the helical radiator extends through a hole in the core plug to contact a center radiator extending in the hollow portion. A cover covers the helical radiator. Preferably, the entire assembly is configured to snap-fit together and to a device. The cover and core plug may snap-fit together. The bottom of the core plug may define a mount and the center radiator may be exposed from the mount as a device contact. The center radiator is also preferably shaped to grab onto the helical radiator. The recess pattern and hole on the core plug allow formation of the helical radiator having the exact pitch defined by the recess pattern by inserting a wire into the hole and applying pressure to the wire while rotating the core plug and wire vis a vis each other to wind the wire into the recess pattern. The cover and core plug are then attached. The helical radiator preferably includes separate lower, middle and upper sections respectively having separate lower, middle and upper pitch angles. The lower pitch angle defines a length of the helical radiator which determines resonance in an upper frequency band. The entire length of the helical radiator determines resonance in a lower frequency band. The middle pitch angle defines a length that acts as a choke with high impedance at the upper frequency band and low impedance at the lower frequency band. A cover is attached to the core plug to cover the helical radiator. An electrical contact contacts the helical radiator and is exposed from the core or cover for contact to a device.

22 Claims, 2 Drawing Sheets

ANTENNA ASSEMBLY AND MULTIBAND STUBBY ANTENNA

FIELD OF THE INVENTION

The field of the invention is small portable antennas. An antenna or antenna assembly of the invention is used in small portable devices, e.g., wireless network portable phones.

BACKGROUND OF THE INVENTION

Worldwide availability of wireless services has created a demand for wireless network phones which are operable worldwide. In different regions of the world there are different frequency allocations. A phone which is operable in each of the different regions requires either multiple antennas or a multi-band antenna which covers the frequency allocations. Multiple band antennas are a better option because wireless network portable phones benefit from compact antennas.

Performance of compact single band and multiband antennas is dependent upon repeatable manufacturing. A key component in multiple band antennas is a helical radiator. Mechanical tolerances for the manufacture of helical radiators have become more exacting as the electrical performance demands of a helical radiator have changed to complement multiband antenna designs. Maintaining proper dimensions oil a helix, e.g., the pitch, diameter, and length, is difficult using conventional spring making machines.

It is also important to have an antenna assembly which is simple to manufacture, as this reduces manufacturing costs. Thus, there is a need for an improved antenna assembly including a helical radiator.

SUMMARY OF THE INVENTION

A compact antenna assembly of the invention includes a helical radiator wound around a nonconductive core plug to provide a desired pitch or pitches in the helical radiator. A preferred compact antenna assembly of the invention includes a nonconductive hollow core plug. The core plug has a recessed pattern on an outside surface into which a helical radiator is wound. An end portion of the helical radiator extends through a hole in the core plug to contact a center radiator extending in the hollow portion. A cover covers the helical radiator. Preferably, the entire assembly is configured to snap-fit together and to a device. The cover and core plug may snap-fit together. The bottom of the core plug may define a mount and the center radiator may be exposed from the mount as a device contact. The center radiator is also preferably shaped to grab onto the helical radiator with a snap-fit.

Such an assembly produces a reliable and convenient assembly method as well. The recess pattern and hole on the core plug allow formation of the helical radiator having the exact pitch defined by the recess pattern by inserting a wire into the hole and applying pressure to the wire while rotating the core plug and wire vis a vis each other to wind the wire into the recess pattern. The cover and core plug are then attached.

Preferred snap-fit connections between the core plug and cover facilitate joining of the antenna assembly together, while a preferred snap mount formation on a bottom portion of the core plug similarly facilitates joining of a finished assembly to a device. In addition, the snap-fit connection between the core plug and cover preferably permits the cover to rotate freely. Where the preferred assembly includes a center radiator that defines a spring contact to a device, the snap-fit joining of a bottom mount portion will also produce reliable electrical contact to a device.

In another aspect of the invention, a configuration of the helical radiator has three separate sections defining three separate radiator stages. This aspect of the invention may be used with the assembly described above having the recess for forming a helical radiator, or it may be used as part of a more basic assembly having the multi-stage helical radiator wound on a core plug. A cover is attached to the core plug to cover the helical radiator. An electrical contact contacts the helical radiator and is exposed from the core or cover for contact to a device.

The helical radiator including separate lower, middle and upper sections respectively having separate lower, middle and upper pitch angles provides multiple band operation. A length of the lower section determines a resonance frequency of a high band. The middle section serves as a choke with high impedance at high bands and low impedance at low bands. The total wire length of the lower, middle and top sections determines a low band resonance frequency. This aspect of the invention permits double band, e.g., AMPS/GSM, or triple band, e.g., AMPS/GSM/PCS, operation. An increase of the bandwidth in the high band to realize quad band operation with adjacent high bands and adjacent low bands, e.g., AMPS/GSM/DCS/PCS or AMPS/GSM/DCS/WCDMA, may be realized with the center radiator discussed above. With a center radiator, the three stage helical radiator forms an antenna in which the high band resonance frequencies are determined together by the length of the lower section of the helical radiator and the length of the central radiator from the point where the helical radiator electrically contacts the central radiator. The low band frequencies are determined by the total length of the helical radiator as in the case where the center radiator is absent.

DETAILED DESCRIPTION OF THE PREFERRED EMBODIMENTS

Figure 1A:
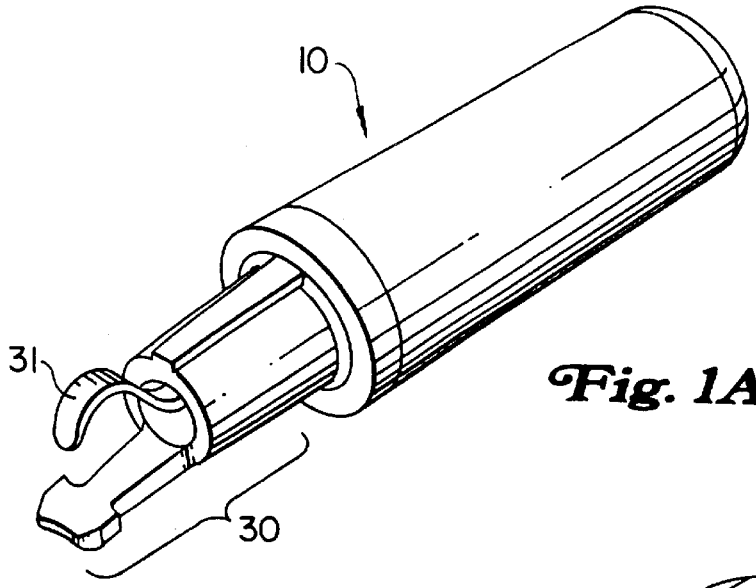
FIGS. 1*a*, 1*b* and 1*c* show a preferred antenna assembly of the invention.
Figure 1B:
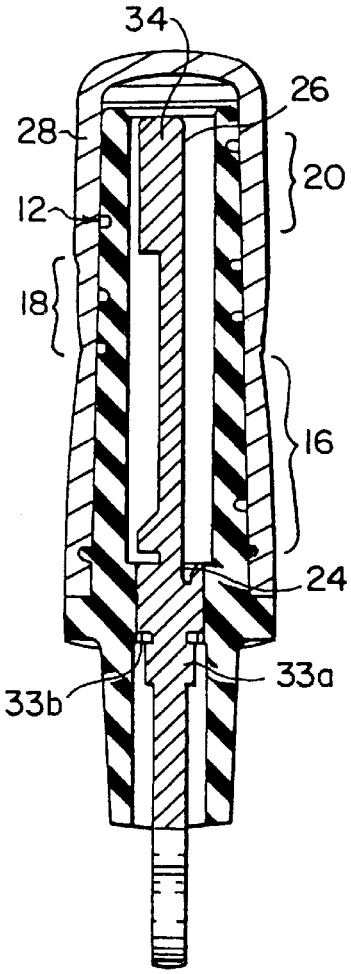
Figure 1C:
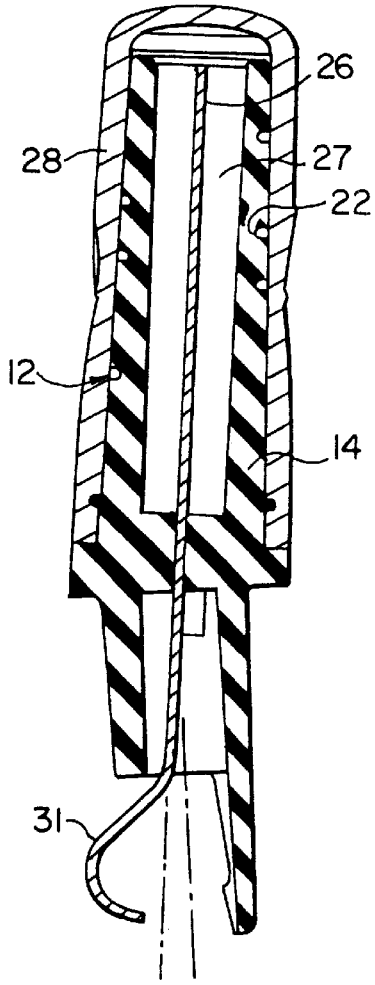
Figure 2:
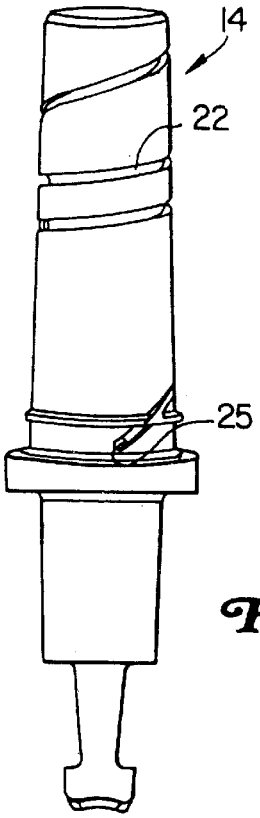
FIG. 2 shows a core plug used in the antenna assembly of FIG. 1.

Referring now to FIGS. 1*a*, 1*b* and 1*c*, a compact antenna assembly 10 includes a helical radiator 12 wound around a nonconductive core plug 14 to provide a desired pitch or pitches in the helical radiator 12. In the preferred embodiment of FIG. 1, three separate pitch sections 16, 18 and 20 are controlled to have separate pitches by a recessed pattern 22 on an outside surface into which the helical radiator 12 is wound. The recessed pattern is best seen in FIG. 2, which shows a preferred core plug 14 prior to winding of a wire into the recessed pattern 22 to form a helical radiator.

The lower pitch angle section 16 defines a length of the helical radiator 12 which determines resonance in an upper frequency band of the antenna. The helical radiator including separate lower, middle and upper sections respectively having separate lower, middle and upper pitch angles provides multiple band operation. The length of the lower section 16 determines a resonance frequency of a high band.

The middle section 18 serves as a choke with high impedance at high bands and low impedance at low bands. The total wire length of the lower, middle and top sections determines a low band resonance frequency. This aspect of the invention permits double band, e.g., AMPS/GSM, or triple band, e.g., AMPS/GSM/PCS, operation. Altering the recessed pattern 22 of the core plug allows formation of helical radiators of other variable pitch and constant pitch designs, as well, with excellent control over the radiator pitch by way of the recessed pattern.

An end portion 24 of the helical radiator 12 extends through a hole 25 in the core plug 14 to contact a center radiator 26 extending into a hollow region 27 formed within the core plug 14. The center radiator 26 facilitates an increase of the bandwidth in the high band to realize quad band operation with adjacent high bands and adjacent low bands, e.g., AMPS/GSM/DCS/PCS or AMPS/GSM/DCS/WCDMA. With the center radiator 26, the three stage helical radiator 12 forms an antenna in which the high band resonance frequencies are determined together by the length of the lower section 16 of the helical radiator and the length of the central radiator 26 from the point where the helical radiator 12 electrically contacts the central radiator 26. The low band frequencies are determined by the total length of the helical radiator 12 as would be the case where the center radiator 26 is omitted and the helical radiator 12 was contacted, for example, by an electrode.

A cover 28 covers the recessed pattern 22 to protect the helical radiator 12. Preferably, the entire assembly is configured to snap fit together and to a device. The cover 28 and core plug 14 snap fit together. The cover 28 snap fits onto the core plug 14, while allowing space between the cover 28 and helical radiator 12 and leaving the cover free to rotate. Free rotation of the cover 28 protects the helical radiator 12 from users of phones or other portable wireless devices including the present antenna assembly. Many users like to rotate the outer antenna assembly, i.e., the cover, by habit The free rotation prevents damage to the helical radiator 12 during such play with antenna assembly.

The bottom of the core plug 14 defines a snap fit mount 30 through which a portion 31 of the center radiator 26 is exposed as a device contact. The bottom portion 31, due to its shape and will be compressed inward as the assembly is slid into place to obtain contact with a device contact by spring force. This permits a quick and reliable snap fit assembly to a device with which the antenna assembly 10 will be used.

Figure 3:
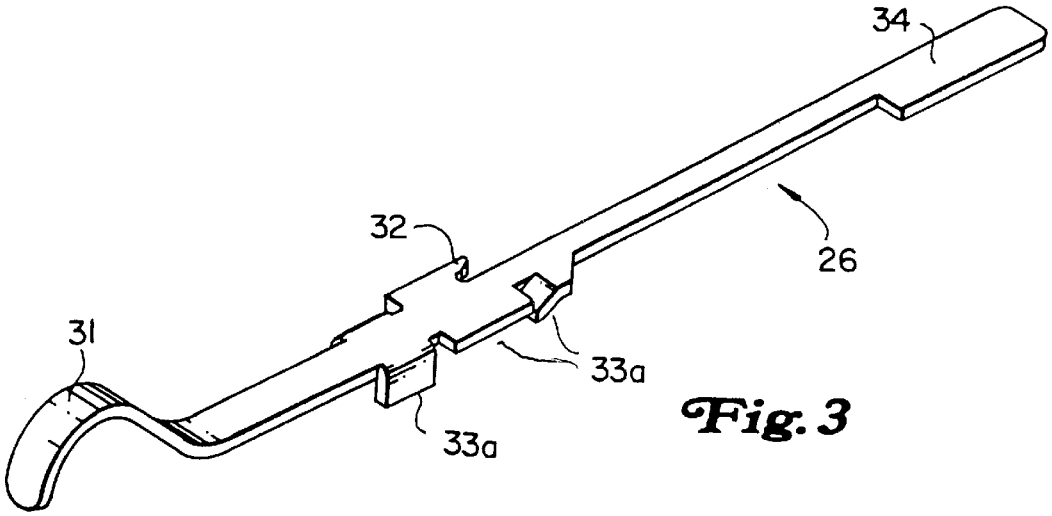
FIG. 3 shows a center radiator used in the antenna assembly of FIG. 1.

Referring now to FIG. 3, aspects of the preferred center radiator 26 aid both assembly and performance. The center radiator 26 is shaped to include a hook portion 32 usable to grab and lock, i.e. snap-fit, onto the end portion 24 of the helical radiator 12 during assembly to form reliable contact therebetween. Separate snap-fit portions 33*a* serve to fit the center radiator 26 securely to corresponding locking portions 33*b* of the core 14. An opposite end portion 34 of the center radiator 26 is shaped to reduce physical length of the center radiator 26 as compared to straight center radiator which is straight and uniform but has the same electrical length. The center radiator 26 may be differently shaped, e.g., as a straight wire or in other shapes which seek to reduce physical length. As an additional example, a straight wire having a return portion at its end produces a reduced physical length with the total wire length defining electrical length. Many other shapes to reduce physical length will be apparent to artisans.

The preferred assembly produces a reliable and convenient assembly method as well. The recess pattern 22 and hole 25 on the core plug 14 allow formation of a helical radiator having the exact pitch defined by the recess pattern by inserting a wire into the hole 25 and applying pressure to the wire while rotating the core plug and wire vis a vis each other to wind the wire into the recess pattern 22. Specifically, a wire is wound onto the core plug 14 after the wire is inserted into the hole 25. Turning the core plug 14 while feeding the wire into the recess pattern 22 performs the winding operation. A simple block with a v-notch may be used to support the core plug 14. The wire will follow the shape of the recess pattern due to force exerted on the wire by the block.

The simple assembly technique permits the length of the wire to be precisely measured since it is measured in a straight line. This permits excellent consistency in resonance frequency from antenna to antenna. As the recess pattern 22 holds the pitch of the wire which becomes the helical radiator 12, bandwidth of the helical radiator 12 also remains highly consistent. A consistent contact point and resistance is obtained by virtue of the unitary center radiator 26 and the manner in which it snap-fits onto contact with the helical radiator 12 and forms a spring contact to phone circuits. The machine used for formation of the helical radiator is also inexpensive and simple, providing an additional manufacturing advantage.

The center radiator 26 itself provides a unitary radiator and contact structure which avoids the need to provide a separate contact or electrode to contact phone circuits. The hook portion 32 of the center radiator 26 grabs the wire as the snap-fit portions 33*a* lock together with the lock portions 33*b* of the core plug 14. The cover 28 and core plug 14 are then attached. A highly consistent pitch is established from assembly to assembly during manufacture with minimal complexity.

Figure 4:
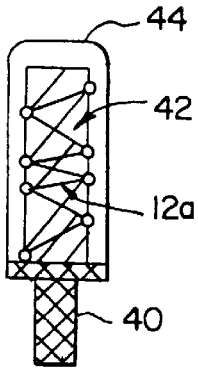
FIG. 4 shows an alternate preferred antenna assembly of the invention.

However, though the preferred assembly includes the center radiator and the recessed portions, these features may not be necessary in all applications. The assembly, independent of the center radiator and recessed portions still provides a highly manufacturable antenna, and an efficient multiband antenna using the multiple pitch radiator of the invention, which can be further extended into an additional band with a center radiator. These features are reflected in an modified preferred embodiment shown in FIG. 4, where a metallic ferrule 40 serves as a device contact and contact to a helical radiator 12*a* formed into the three pitch sections described above. A core plug 42 supports the radiator 12*a*. A cover 44 protects the radiator 12*a*.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A compact antenna assembly comprising:

a core plug of nonconductive material, the core plug defining a hollow region within and having a recessed pattern on an outside portion thereof;

a helical radiator wound into said recessed pattern, an end portion of said helical radiator extending through a hole in the core plug;

a center radiator extending into said hollow region, said center radiator being shaped to contact said end portion of said helical radiator; and a cover covering at least said recessed pattern on said outside portion.

2. The compact antenna assembly of claim 1, wherein said center radiator extends out of said hollow portion to form a contact.

3. The compact antenna assembly of claim 2, wherein said core plug defines a mount at one end.

4. The compact antenna assembly of claim 3, wherein said center radiator is shaped to define a spring at one end which is exposed from said mount and may be compressed inwardly.

5. The compact antenna assembly of claim 1, wherein said center radiator includes an enlarged flat portion at one end which is contained in said hollow portion.

6. The compact antenna assembly of claim 1, wherein said center radiator is shaped to grab said end portion of said helical radiator.

7. The compact antenna assembly of claim 6, wherein said center radiator includes a hook portion to grab said end portion of said helical radiator.

8. The compact antenna assembly of claim 1, wherein said cover snap fits to a portion of said core plug.

9. The compact antenna assembly of claim 8, wherein a space is defined between said cover and said helical radiator.

10. The compact antenna assembly of claim 9, wherein said cover is free to rotate around said helical radiator.

11. The compact antenna assembly of claim 1, wherein said recessed pattern defines multiple pitches in said helical radiator.

12. The compact antenna assembly of claim 9, wherein said recessed pattern defines different lower pitch, middle pitch and upper pitch angles in said helical radiator.

13. The compact antenna assembly of claim 12, wherein said lower pitch angle defines a length of said helical radiator which determines resonance in an upper frequency band, an entire length of said helical radiator determines resonance in a lower frequency band, and said middle pitch angle defines a length of radiator which acts as a choke with high impedance at said upper frequency band and low impedance at said lower frequency band.

14. A compact antenna assembly comprising:

a core plug of nonconductive material;

a helical radiator wound around said core plug, said helical radiator including separate lower, middle and upper sections respectively having separate lower, middle and upper pitch angles, wherein said lower pitch angle defines a length of said helical radiator which determines resonance in an upper frequency band, an entire length of said helical radiator determines resonance in a lower frequency band, and said middle pitch angle defines a length of radiator which acts as a choke with high impedance at said upper frequency band and low impedance at said lower frequency band;

a cover attached to said core plug and covering said helical radiator;

an electrical contact to said helical radiator, said electrical contact being exposed for contact to a device.

15. The compact antenna assembly according to claim 14, wherein said electrical contact comprises an electrode disposed at an end of said core plug to contact said helical radiator.

16. The compact antenna assembly of claim 14, wherein said cover snap fits to a portion of said core plug.

17. The compact antenna assembly of claim 16, wherein said cover is free to rotate around said helical radiator.

18. A compact antenna assembly comprising:

a core plug of nonconductive material, the core plug defining a hollow region within;

a helical radiator wound around said core plug, an end portion of said helical radiator extending through a hole in the core plug;

a unitary combination center radiator and device contact extending into said hollow region, said center radiator contacting said end portion of said helical radiator and extending out from said core plug as a device contact; and a cover covering at least said helical radiator.

19. The compact antenna assembly of claim 18, wherein said center radiator snap fits onto said end portion of said helical radiator.

20. A four band antenna comprising:

a helical radiator wound into three separate pitch sections around a core plug, a middle one of said three pitch sections defining a choke section;

a core supporting said helical radiator; and a center radiator within said core and contacting an end portion of the helical radiator, wherein four band supported by the antenna comprise two adjacent low bands and two adjacent high bands.

21. The antenna of claim 20, wherein said four bands comprise AMPS,GSM,DCS, and PCS.

22. The antenna of claim 20, wherein said four bands comprise AMPS, GSM, DCS, and WCDMA.

* * * * *

UNITED STATES PATENT AND TRADEMARK OFFICE

CERTIFICATE OF CORRECTION

PATENT NO. : 6,369,775 B1
DATED : April 9, 2002
INVENTOR(S) : Moore et al.

It is certified that error appears in the above-identified patent and that said Letters Patent is hereby corrected as shown below:

Column 1,
Line 28, delete “oil” and insert -- on --

Signed and Sealed this

Twenty-fifth Day of February, 2003

JAMES E. ROGAN
*Director of the United States Patent and Trademark Office*